US005415015A

United States Patent [19]

Klemmer et al.

[11] Patent Number: 5,415,015

[45] Date of Patent: May 16, 1995

[54] ELECTRICAL TERMINAL CRIMPING TOOL

[75] Inventors: Robert A. Klemmer, Wheaton; Russell E. Wende, Oak Lawn, both of Ill.

[73] Assignee: Molex Incorporated, Lisle, Ill.

[21] Appl. No.: 275,098

[22] Filed: Jul. 14, 1994

Related U.S. Application Data

[63] Continuation of Ser. No. 137,233, Oct. 14, 1993, abandoned.

[51] Int. Cl.[6] ..... H01R 43/04

[52] U.S. Cl. ..... 72/412; 72/410; 29/751

[58] Field of Search ..... 72/412, 410, 416; 29/751, 753

[56] References Cited

U.S. PATENT DOCUMENTS

| | | | |
|---|---|---|---|
| 2,738,693 | 3/1956 | Logan | 72/410 |
| 2,800,042 | 7/1957 | Demler | 72/410 |
| 3,800,584 | 4/1974 | Edwards | 72/410 |
| 4,821,383 | 4/1989 | Grosklos et al. | 29/33 M |

FOREIGN PATENT DOCUMENTS

| | | | |
|---|---|---|---|
| 951885 | 7/1974 | Canada | 29/753 |
| 0356168 | 8/1988 | European Pat. Off. . | |
| 123780 | 4/1992 | Japan | 29/751 |
| 798134 | 7/1958 | United Kingdom | 29/753 |

*Primary Examiner*—Daniel C. Crane
*Attorney, Agent, or Firm*—Stephen Z. Weiss

[57] ABSTRACT

A tool is provided for crimping a sheet metal terminal onto an exposed conductor of an electrical wire. The terminal defines a longitudinal axis and includes a mating end, a terminating end and a transition section therebetween. The terminating end includes a pair of transversely spaced crimp walls, and the transition section includes a pair of transversely spaced transition walls coplanar with and joining the crimp walls to the mating end of the terminal. The tool includes a pair of opposed crimp jaws defined by an anvil for locating the terminal and a crimp die for crimping the crimp walls into generally semi-cylindrical configurations into engagement with the conductor of the electrical wire. The crimp die includes a portion for crimping the transition walls into generally semi-frusto-conical configurations toward the conductor.

12 Claims, 4 Drawing Sheets

ELECTRICAL TERMINAL CRIMPING TOOL

This is a continuation of copending application Ser. No. 08/137,233, filed on Oct. 14, 1993, now abandoned.

FIELD OF THE INVENTION

This invention generally relates to the art of electrical connectors and, particularly, to a tool for crimping the walls of a connector terminal onto the conductor of an electrical wire.

BACKGROUND OF THE INVENTION

One type of terminal for terminating an electrical wire within a connector, generally, is an elongated sheet metal terminal adapted to be crimped onto an exposed conductor of the electrical wire. The terminal includes a mating end, a terminating end and a body or transition section therebetween. The terminating end usually includes two pairs of crimp walls. One pair of walls crimps onto the outer cladding or insulation of the electrical wire, and the other pair of walls crimps onto the exposed conductor of the wire. The transition section includes a base wall which is common to a bottom wall between the crimp walls to define a generally U-shaped configuration. The transition section may include side walls coplanar with the conductor crimp walls, but the side walls of the transition section are relatively short and not as extensive as the crimp walls, because the sheet metal material would tear during crimping of the crimp walls onto the conductor. In essence, the side walls of the transition section define a cut-out in the sides of the terminal between the terminating end and the mating end. In fact, a cut-out normally is formed between the insulation crimp walls and the conductor crimp walls so that the two pairs of walls can be crimped independently or at two different stages without tearing the sheet metal material therebetween.

One of the problems with electrical terminals as described above concerns the electrical current carrying capacity or the current flow characteristics of such terminals. Specifically, when the side walls of the terminal are cut-out or otherwise reduced in dimensions between the conductor crimp walls and the mating end of the terminal, the overall cross-sectional area of the terminal is reduced in the transition section thereof. This, in turn, reduces the current carrying capabilities of the terminal. In addition, such reduced sections of the terminal decrease the structural integrity of the terminal at that point. In fact, such terminals have a tendency to bend or deform at such transition sections.

The present invention is directed to a tool which is capable of crimping such terminals as described above and, particularly, to a tool which is capable of crimping the walls of the transition section along with the conductor crimp walls in a unique configuration, whereby an electrical terminal can be provided to solve the problems identified above and to satisfy a need for such an electrical terminal with improved current flow characteristics.

SUMMARY OF THE INVENTION

An object, therefore, of the invention is to provide a new and improved tool for crimping an electrical terminal onto an exposed conductor of an electrical wire.

In the exemplary embodiment of the invention, the terminal is a stamped and formed sheet metal component in an elongated configuration defining a longitudinal axis. The terminal includes a mating end, a terminating end and a transition section therebetween. The terminating end has a pair of transversely spaced crimp walls, and the transition section has a pair of transversely spaced transition walls coplanar with and joining the crimp walls to the mating end of the terminal. The walls are generally parallel to the longitudinal axis.

The tool includes a pair of opposing crimp jaws, defined by an anvil means for locating the terminal and a crimp die means for crimping the crimp walls into generally semi-cylindrical configurations into engagement with the conductor of the electrical wire. The invention contemplates that the crimp die means include a portion for crimping the transition walls into generally semi-frusto-conical configurations toward the conductor.

Therefore, while the crimp walls are curled into complete crimping engagement with the conductor, the transition walls are only partially curled toward the conductor in their generally semi-frusto-conical configurations. With the structure of the terminal formed by the tool of this invention, the transition section of the terminal has a current carrying capability substantially to that of the conductor of the electrical wire, the transition section is not reduced in cross-section sufficient to diminish the structural integrity of the terminal, and the terminal does not have a tendency to bend at the transition section. In essence, the simple structural configuration of the terminal formed by the tool solves all of the problems described in the "Background", above.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
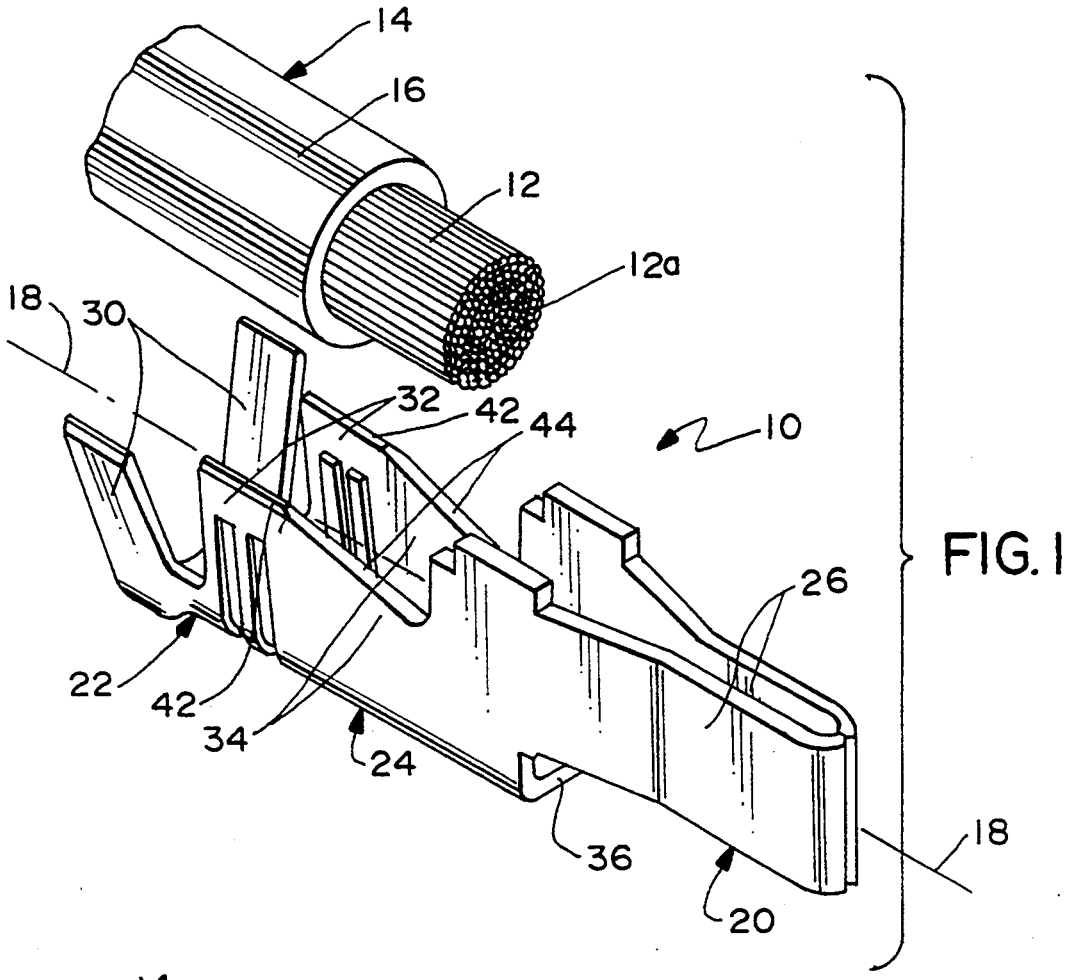
FIG. 1 is a perspective view of one type of a terminal capable of being terminated by the tool of the invention, the terminal being in uncrimped condition, along with a depiction of a "stripped" end of an electrical wire.
Figure 2:
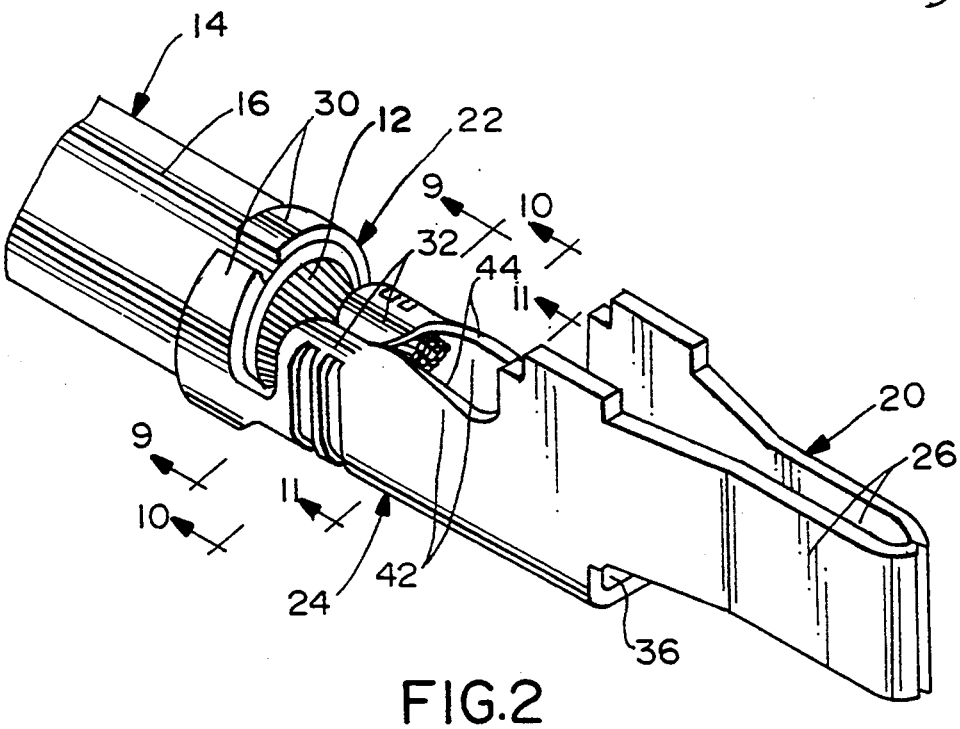
FIG. 2 is a perspective view of the terminal fully crimped onto the electrical wire.

Referring to the drawings in greater detail, and first to FIGS. 1 and 2, the tool of the invention is adapted for terminating an elongated, stamped and formed sheet metal terminal, generally designated 10. The terminal is adapted to be crimped onto an exposed conductor 12 of an electrical wire, generally designated 14. An outer cladding or sheath 16 of insulating material surrounds conductor 12. The conductor has a given cross-sectional area as defined by end 12a (FIG. 1).

Elongated terminal 10 defines a longitudinal axis 18 and includes a mating end, generally designated 20, a terminating end, generally designated 22, and a transition section, generally designated 24, between the mating and terminating ends.

Figure 3:
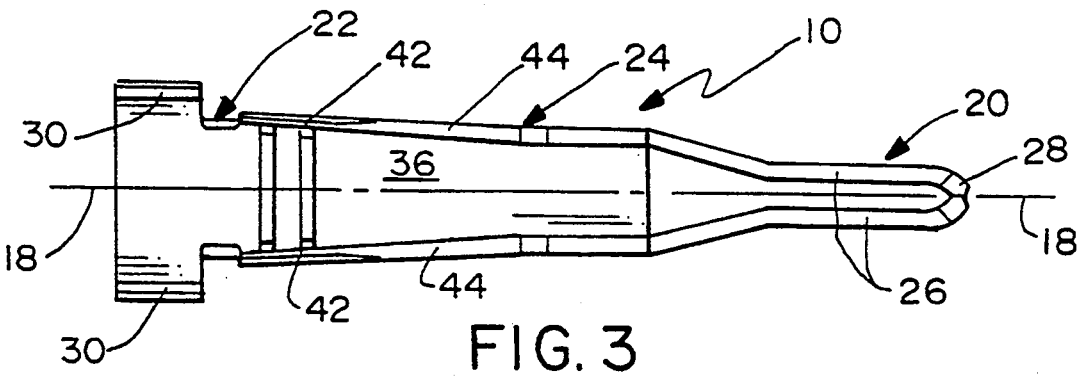
FIG. 3 is a top plan view of the terminal in uncrimped condition.
Figure 4:
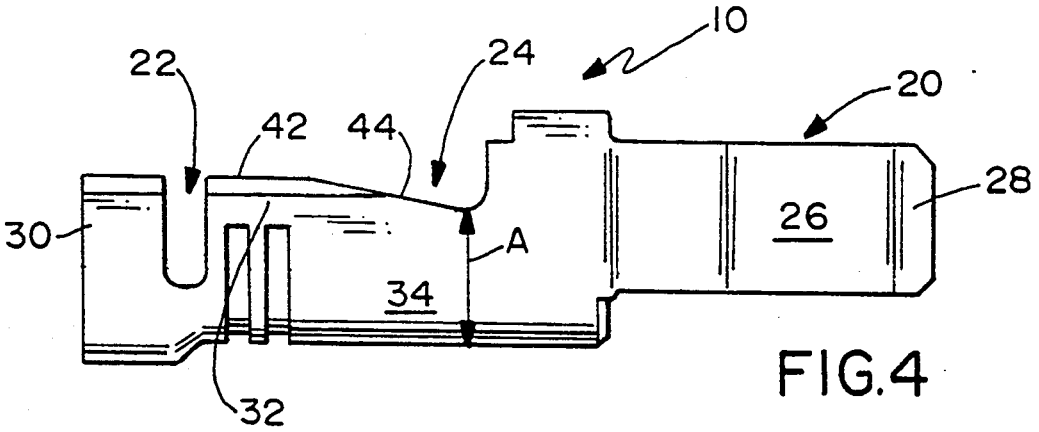
FIG. 4 is a side elevational view of the uncrimped terminal.

Referring to FIGS. 3 and 4 in conjunction with FIGS. 1 and 2, mating end 20 of terminal 10 is a male mating end as defined by a pair of juxtaposed blades 26 which are slightly spaced transversely, but which converge at a moderately pointed distal end 28 for guiding the terminal into a mating female terminal (not shown). At this point, it should be understood that the concepts of the invention relating to the terminating end and transition section of terminal 10 are equally applicable to a terminal configured to be a female terminal or to a terminal having a different type of mating end than that shown herein.

Terminating end 22 of terminal 10 includes a pair of transversely spaced insulation crimp walls 30. These crimp walls are adapted to be crimped onto insulation 16 of electrical wire 14 as shown by the crimped condition of the terminal in FIG. 2. The terminating section also includes a pair of transversely spaced conductor crimp walls 32. These crimp walls are adapted to be crimped onto exposed conductor 12 of electrical wire 14, again as shown by the crimped condition of the terminal in FIG. 2. In essence, conductor crimp walls 32 (as well as insulation crimp walls 30) are adapted to be crimped into generally semi-cylindrical configurations as seen in FIG. 2.

Transition section 24 of terminal 10 includes a pair of spaced transition walls 34 joining conductor crimp walls 32 to blades 26 of mating end 20 of the terminal. Insulation crimp walls 30, conductor crimp walls 32 and transition walls 34 all project upwardly from a common base wall 36, whereby the overall configuration of the terminating end and the transition section of the terminal is generally U-shaped.

Transition section 24 which joins conductor crimp walls 32 to mating end 20, has a minimum cross-sectional area at any given axial location of at least 65% of the given cross-sectional area 12a of conductor 12. This given axial location is seen by the double-headed arrow "A" in FIG. 4. In other words, this location is at the narrowest dimensions of transition walls 34.

From a structural standpoint, and referring to FIGS. 1 and 3, conductor crimp walls 32 have edges 42 which extend generally parallel to longitudinal axis 18 of the terminal which, in turn, generally is the longitudinal axis of electrical wire 14 and its conductor 12. Therefore, the conductor crimp walls are curled into generally semi-cylindrical configurations into crimping engagement with conductor 12 as seen in FIG. 2.

Figure 9:
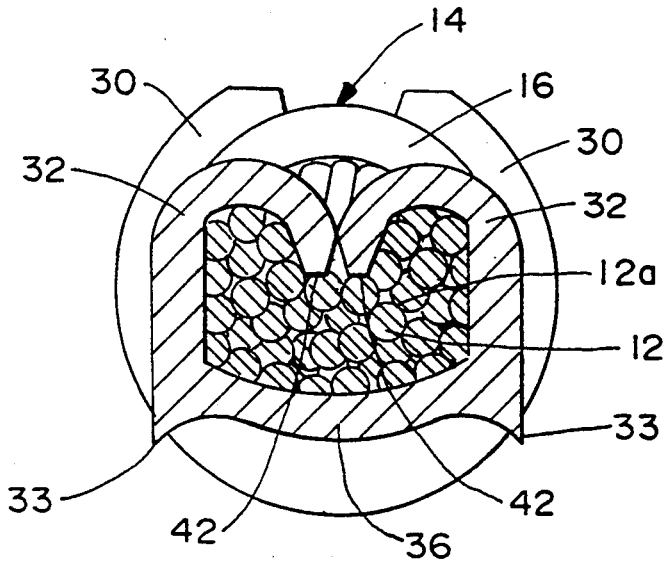
FIG. 9 is a vertical section taken generally along line 9—9 of FIG. 2.
Figure 10:
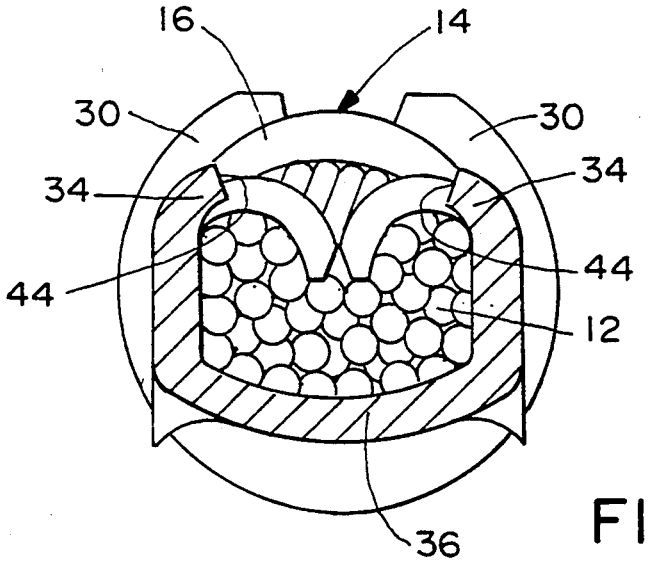
FIG. 10 is a vertical section taken generally along line 10—10 of FIG. 2.
Figure 11:
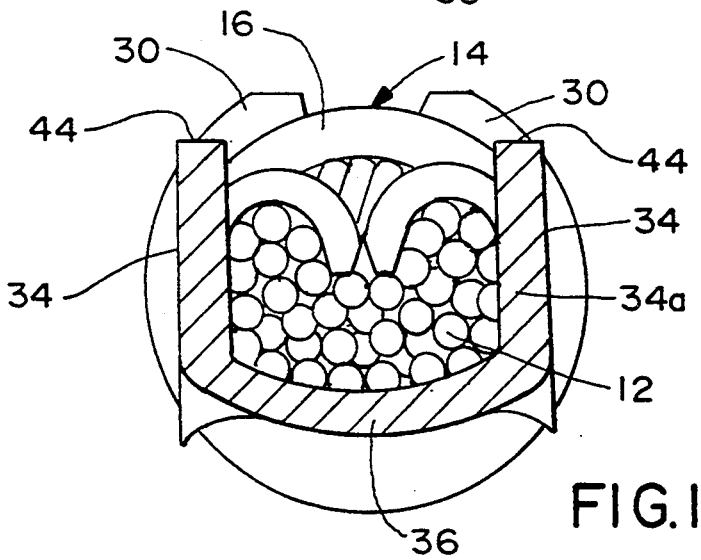
FIG. 11 is a vertical section taken generally along line 11—11 of FIG. 2.

Transition walls 34 of transition section 24 have edges 44 which extend from edges 42 of the conductor crimp walls toward the mating end of the terminal at an acute angle of about 30° to axis 18 and base wall 36. The edges of the transition walls extend at an angle toward the axial location of the minimum cross-sectional area of the transition section, as represented by arrow "A" in FIG. 4. Therefore, transition walls 34 are adapted to be partially curled toward conductor 12 in generally semi-frusto-conical configurations as seen in FIG. 2. These curled configurations of conductor crimp walls 32 and transition walls 34 also can be seen by the sectional views of FIGS. 9–11. It can be understood how the cross-sectional area at the location identified by double-headed arrow "A" (FIG. 4) can be easily calculated. The metal material at this point has a defined thickness and a defined width which define a minimum cross-sectional area of at least 65% of the cross-sectional area 12*a* of conductor 12. Therefore, the current carrying capabilities of the terminal are substantially that of the conductor, itself.

Figure 5:
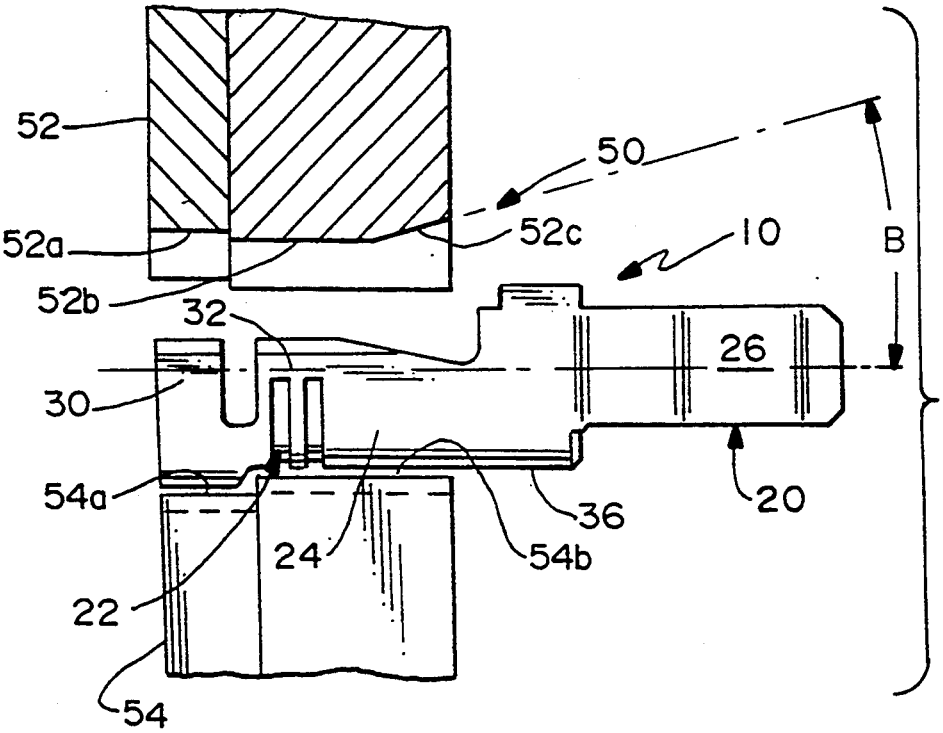
FIG. 5 is a side elevational view of the uncrimped terminal between the jaws of a crimping tool according to the invention.
Figure 6:
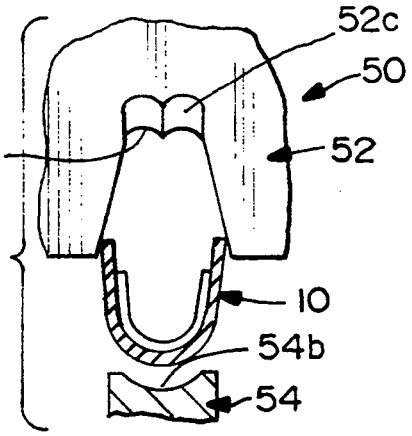
FIG. 6 is a side elevational view looking toward the right side of FIG. 5, with a section through the terminal.
Figure 7:
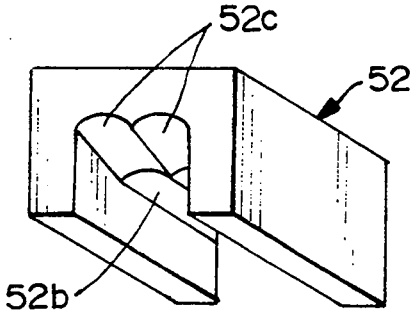
FIG. 7 is a perspective view looking toward the underside of the upper jaw of the crimping tool.

FIGS. 5–7 show a crimping tool, generally designated 50 (FIG. 5), which incorporates the concepts of the invention and which is designed for crimping insulation crimp walls 30, conductor crimp walls 32 and transition walls 34 of terminal 10. More particularly, one of the terminals is shown in FIG. 5 positioned between a pair of crimp jaws defined by an upper press or crimp die means, generally designated 52, and a lower anvil means, generally designated 54. The anvil means includes a first portion 54a for backing the terminal behind insulation crimp walls 34 and a second portion 54*b* for backing the terminal behind conductor crimp walls 32 and transition walls 34.

Upper press die means 52 has a first section 52*a* which has a downward die configuration of an inverted "W" as is known in the art for crimping insulation crimp walls 30 into generally semi-cylindrical configurations onto insulation 16 of electrical wire 14 as seen in FIG. 2. Similarly, upper press die means 52 has a second portion 52*b* which faces downwardly in a generally inverted "W" cross-section and is formed for crimping conductor crimp walls 32 into generally semi-cylindrical configurations in engagement with conductor 12, again as seen in FIG. 2. Both the first and second sections 52*a*,52*b* extend in a direction parallel to the longitudinal axis of the terminal.

Figure 12:
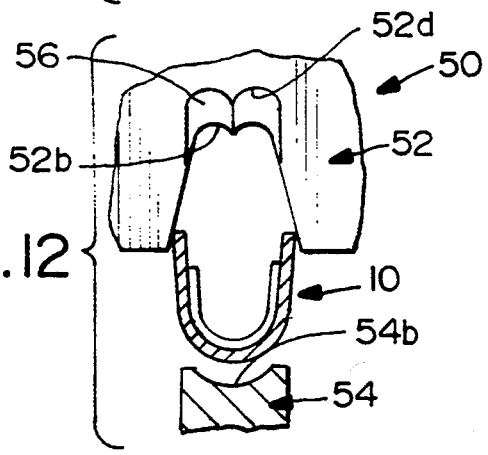
FIG. 12 is a side elevation view looking toward the right side of FIG. 5 with a section through the terminal showing alternate upper crimp die means.
Figure 13:
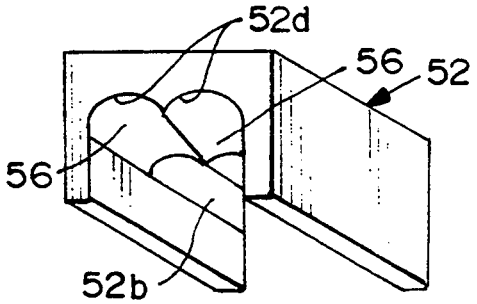
FIG. 13 is a perspective view looking toward the underside of the upper crimp die means in FIG. 12.

However, upper press die means 52 of crimping tool 50 has a unique third portion or section 52*c* which, at any given axial point, also has an inverted "W" configuration in cross-section. However, the third portion 52*c* of the upper press die means extends in a direction at an angle "B" to the longitudinal axis of the terminal where the angle opens away from the portion 52*b* which crimps conductor crimp walls 32, in order to partially crimp transition walls 34 toward the conductor. In an alternate embodiment as shown in FIGS. 12 and 13, the third portion 52*d* of the upper press die means tapers outwardly or flares away from the portion 52*b* which crimps the conductor crimp walls 32. This third portion 52*d* defines a pair of adjacent semi-frusto-conical surfaces 56 which form the transition walls into the crimped semi-frusto-conical configuration.

Figure 8:
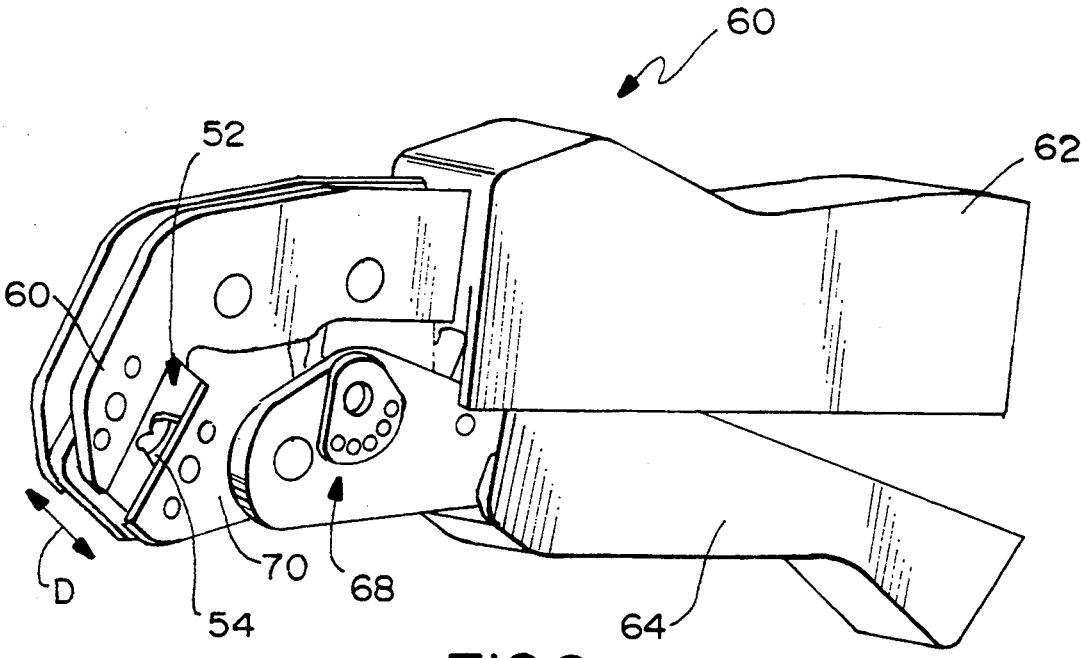
FIG. 8 is an exploded perspective view of a hand tool incorporating the crimping jaws of the invention.

FIG. 8 shows one type of tool within which the concepts of the invention can be incorporated, namely a hand tool, generally designated 60. The hand tool is in the form of a pliers-type tool which includes a pair of handles 62 and 64 to be gripped by a user. However, it should be understood that the concepts of the invention are applicable for incorporation in a wide range of applications or terminating tools other than hand tools, such as bench tools, assembly-line tools, and so on.

Briefly, handle 62 of hand tool 60 in FIG. 8 is fixed to a first jaw 66, and handle 64 is coupled through a toggle connection, generally designated 68, to a second jaw 70, whereby jaws 66 and 70 oppose each other and are movable toward and away from each other in the direction of double-headed arrow "D". Upper press die means 52 (FIGS. 5–7) are mounted within jaw 66, and lower anvil means 54 are mounted in jaw 70, whereby the upper press die means and the lower anvil means oppose each other as shown in FIG. 5 and described above.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a tool for crimping a sheet metal terminal onto an exposed conductor of an electrical wire, wherein the terminal having a base defines a longitudinal axis and includes a mating end, a terminating end and a transition section therebetween, the terminating end including at least one crimp wall extending upwardly from the base and ending in an edge generally parallel to the terminal longitudinal axis, and the transition section including at least one transition wall extending upwardly from the base ending in an edge, said transition wall edge extending from the crimp wall edge at an angle to the terminal longitudinal axis so that the distance the edge of the transition wall extends from the base gradually diminishes from the crimp wall edge to the mating end of the terminal, the walls being generally parallel to said axis, wherein the tool includes a pair of opposing crimp jaws defined by an anvil means for locating the terminal base and an upper press die means having a first contacting surface for crimping the crimp wall into a generally semi-cylindrical configuration into engagement with the conductor of the electrical wire, and wherein the improvement comprises said upper press die means including a portion having a second contacting surface for crimping the transition wall into a generally semi-frusto-conical configuration toward the conductor and wherein the first and second contacting surfaces have edges in direct contact with one another.

2. In the tool of claim 1, wherein said first contacting surface in said upper press die means include a semi-cylindrical surface extending in a direction parallel to the longitudinal axis of the terminal for engaging the crimp wall.

3. In the tool of claim 1, wherein said second contacting surface in said transition wall portion of said upper press die means include a generally semi-frusto-conical surface for engaging the transition wall.

4. In the tool of claim 1, wherein said second contacting surface is generally arch-shaped and extends from said first contacting surface away from said anvil means.

5. In the tool of claim 1, further comprising a third contacting surface for crimping a portion of said terminal onto a length of insulation of said electrical wire, said first contacting surface being positioned between said second and third contacting surface.

6. In a tool for crimping a sheet metal terminal onto an exposed conductor of an electrical wire, wherein the terminal having a base is a stamped and formed sheet metal component in an elongated configuration defining a longitudinal axis, the terminal including a mating end, a terminating end and a transition section therebetween, the terminating end having a pair of transversely spaced crimp walls each extending upwardly from the base and ending in an edge generally parallel to the terminal longitudinal axis, and the transition section having a pair of transversely spaced transition walls each extending upwardly from the base and ending in an edge, said transition wall edge extending from the crimp wall edge at an angle to the terminal longitudinal axis so that the distance the edge of the transition wall extends from the base gradually diminishes from the crimp wall edge to the mating end of the terminal coplanar with and joining the crimp walls to the mating end of the terminal, the walls being generally parallel to said axis, wherein the tool includes a pair of opposing crimp jaws defined by an anvil means for locating the terminal and an upper press die means having first contacting surfaces for crimping the crimp walls into generally semi-cylindrical configurations into engagement with the conductor of the electrical wire, and wherein the improvement comprises said upper press die means including a portion having second contacting surfaces for crimping the transition walls into generally semi-frusto-conical configurations toward the conductor and wherein the first and second contacting surfaces have edges in contact with one another.

7. The tool of claim 6, wherein said first contacting surfaces in said upper press die means include a pair of adjacent semi-cylindrical surface extending in a direction parallel to the longitudinal axis of the terminal for engaging the crimp walls.

8. The tool of claim 6, wherein said second contacting surface in said transition wall portion of said upper press die means include a pair of adjacent semi-frusto-conical surfaces for engaging the transition walls.

9. In the tool of claim 6, wherein said second contacting surfaces are generally arch-shaped and extend from said first contacting surfaces away from said anvil means.

10. In the tool of claim 6, further comprising third contacting surfaces for crimping a portion of said terminal onto a length of insulation of said electrical wire, said first contacting surfaces being positioned between said second and third contacting surface.

11. In a tool for crimping a sheet metal terminal onto an exposed conductor of an electrical wire, wherein the terminal having a base defines a longitudinal axis and includes a mating end, a terminating end and a transition section therebetween, the terminating end including at least one crimp wall extending upwardly from the base and ending in an edge generally parallel to the terminal longitudinal axis, and the transition section including at least one transition wall extending upwardly from the base ending in an edge, said transition wall edge extending from the crimp wall edge at an angle to the terminal longitudinal axis so that the distance the edge of the transition wall extends from the base gradually diminishes from the crimp wall edge to the mating end of the terminal, the walls being generally parallel to said axis, wherein the tool includes a pair of opposing crimp jaws defined by an anvil means for locating the terminal base and an upper press die means having a first contacting surface for crimping the crimp wall into a generally semi-cylindrical configuration into engagement with the conductor of the electrical wire, and wherein the improvement comprises said upper press die means including a portion having a second contacting surface for crimping the transition wall into a generally semi-cylindrical configuration toward the conductor extending in a direction at an angle to the longitudinal axis of the terminal where the angle opens away from the crimp wall portion of said upper press die and wherein the first and second contacting surfaces have edges in direct contact with one another.

12. In a tool for crimping a sheet metal terminal onto an exposed conductor of an electrical wire, wherein the terminal having a base is a stamped and formed sheet metal component in an elongated configuration defining a longitudinal axis, the terminal including a mating end, a terminating end and a transition section therebetween, the terminating end having a pair of transversely spaced crimp walls each extending upwardly from the base and ending in an edge generally parallel to the terminal longitudinal axis, and the transition section having a pair of transversely spaced transition walls each extending upwardly from the base and ending in an edge, said transition wall edge extending from the crimp wall edge at an angle to the terminal longitudinal axis so that the distance the edge of the transition wall extends from the base gradually diminishes from the crimp wall edge to the mating end of the terminal coplanar with and joining the crimp walls to the mating end of the terminal, the walls being generally parallel to said axis, wherein the tool includes a pair of opposing crimp jaws defined by an anvil means for locating the terminal and an upper press die means having first contacting surfaces for crimping the crimp walls into generally semi-cylindrical configurations into engagement with the conductor of the electrical wire, and wherein the improvement comprises said upper press die means including a portion having second contacting surfaces for crimping the transition walls into generally semi-cylindrical configurations toward the conductor extending in a direction at an angle to the longitudinal axis of the terminal where the angle opens away from the crimp wall portion of said upper press die, and wherein the first and second contacting surfaces have edges in contact with one another.

* * * * *